United States Patent [19]

Bliss

[11] Patent Number: 4,750,316

[45] Date of Patent: Jun. 14, 1988

[54] EGG PACKER WITH EGG ALIGNMENT DEVICE

[75] Inventor: George N. Bliss, Franklin, Mich.

[73] Assignee: Diamond Automations, Inc., Farmington Hills, Mich.

[21] Appl. No.: 68,149

[22] Filed: Jun. 29, 1987

[51] Int. Cl.[4] ..... B65B 35/58; B65B 5/10

[52] U.S. Cl. ..... 53/475; 53/246; 53/247; 53/248; 53/534

[58] Field of Search ..... 53/446, 475, 473, 534, 53/544, 246, 247, 537, 539, 248

[56] References Cited

U.S. PATENT DOCUMENTS

| | | | |
|---|---|---|---|
| 3,311,216 | 3/1967 | Jones | 53/534 X |
| 3,525,195 | 8/1970 | Mosterd | 53/534 |
| 3,722,173 | 3/1973 | Noguchi | 53/534 X |
| 3,820,301 | 6/1974 | Willsey | 53/534 X |
| 3,964,233 | 6/1976 | Thomas | 53/544 X |
| 3,974,624 | 8/1976 | Bentley et al. | 53/534 |
| 4,189,898 | 2/1980 | Moulds et al. | 53/544 X |
| 4,575,993 | 3/1986 | Meyn | 53/544 X |

*Primary Examiner*—Horace M. Culver
*Attorney, Agent, or Firm*—Kenyon & Kenyon

[57] ABSTRACT

An egg packing apparatus includes an endless conveyor including a plurality of rotatable parallel rollers each provided with a plurality of abutments in the form of annular flanges. The flanges of any one roller are aligned with flanges on other rollers to form a plurality of transport channels or feed paths extending to respective guide chutes. The guide chutes are each defined by a pair of opposing side walls, a pivotably mounted plate member and an additional wall opposite the plate member 36, the additional wall being provided with a V-shaped portion extending inwardly towards the plate member so that the guide chute has a decreased width in a central region. Upon the deposition of an egg on the plate member with the narrow end of the egg is contact with one of the side walls of the guide chute, the plate member is pivoted and the large end of the egg is temporarily held between the additional wall and the plate member, allowing the narrow end of the egg to swing downwardly. The egg is then placed narrow end down into a transfer device and transferred to a carton.

30 Claims, 4 Drawing Sheets

Fig. 2.
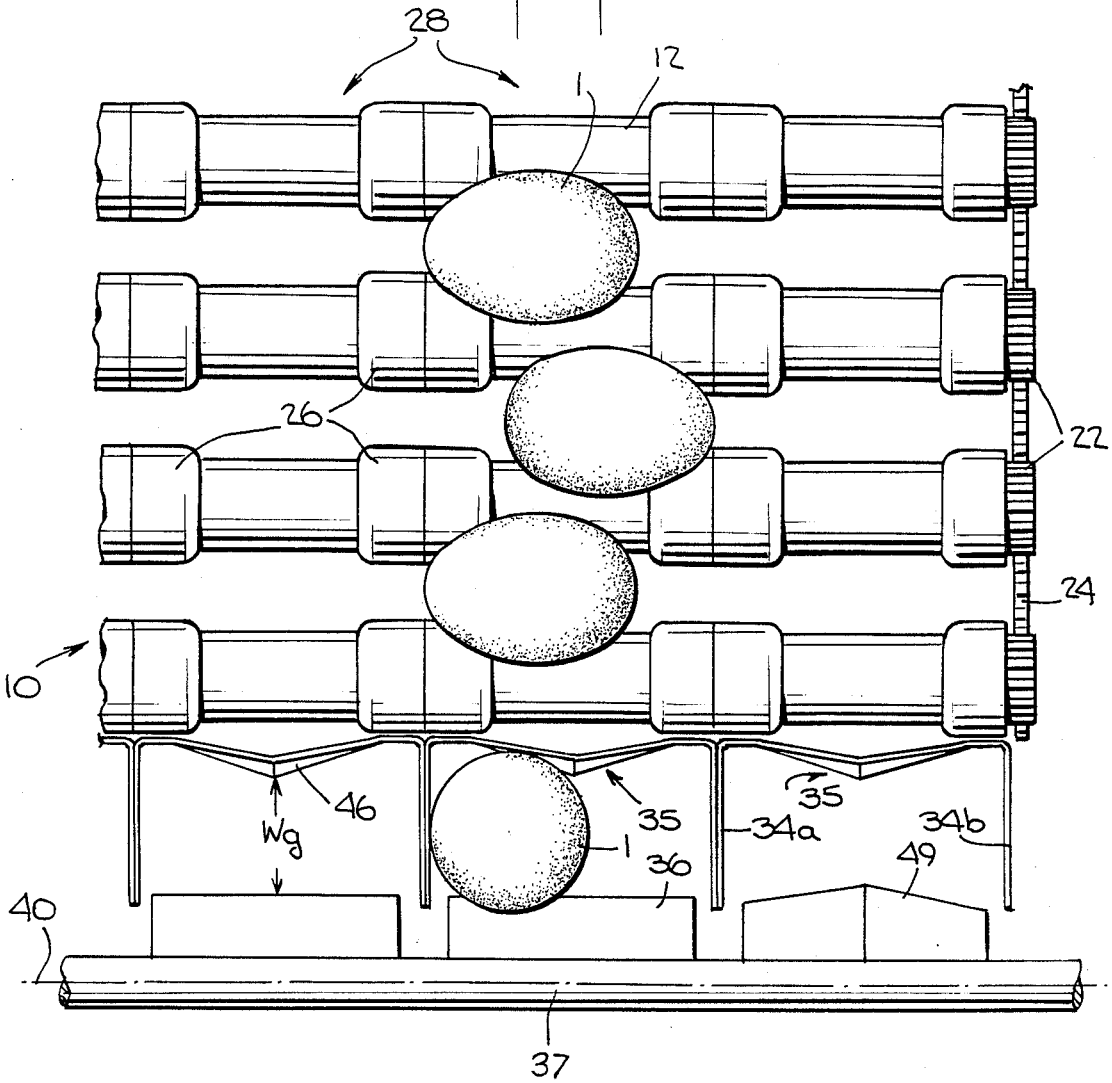
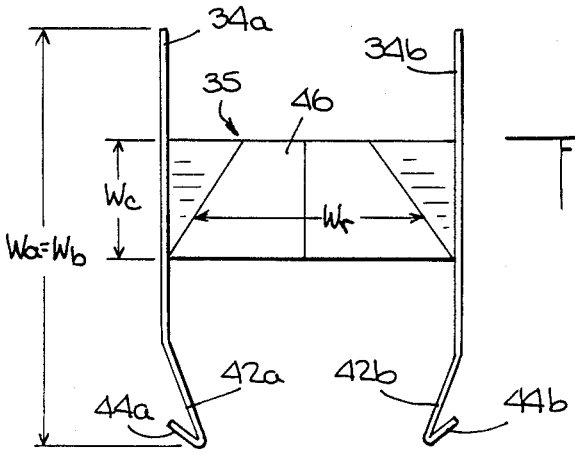
Fig. 3.

EGG PACKER WITH EGG ALIGNMENT DEVICE

BACKGROUND OF THE INVENTION

This invention relates generally to egg handling equipment and particularly to an apparatus for loading eggs into cartons. More specifically, this invention relates to such egg packing apparatus which is provided with means for aligning or orienting an egg to be placed into a receptacle of an egg carton.

It is generally known in the egg processing industry that eggs have a greater storage when the eggs are packed with their small ends facing downwardly in the egg cartons. Various machines have been designed for accomplishing such a packaging. Included among those conventional packing machines are those described in U.S. Pat. No. 3,964,233 issued June 22, 1976 to Leslie P. Thomas and U.S. Pat. No. 4,189,898 issued Feb. 26, 1980 to Frank G. Moulds and Michael A. McCord, both also assigned to the assignee of the instant invention.

As disclosed in U.S. Pat. No. 3,964,233, eggs are carried up an upwardly inclined conveyor which includes a plurality of rotating rollers. The rolling action of the rollers causes each egg to assume a position with its narrower or smaller end in abutment with either of a pair of walls disposed transversely to the longitudinal axes of the rollers on opposite sides of a path of travel of the egg. At the end of the conveyor a spring mounted plow or guide tongue is positioned. The plow is centrally located in relation to the pair of opposing channel walls and causes the egg to turn as it is about to travel over the top of the endless conveyor comprising the rotating rollers. The plow serves to retard the large end of the egg, thereby causing the egg to fall with its narrow end first into a retainer. The downwardly oriented egg is then dropped into a clam shell transfer device which shuttles the egg between the retainer and a receptacle in a carton or other container disposed therebelow. The clam shell moves so as to adjust the horizontal spacing between a plurality of eggs delivered into the same carton.

As described in U.S. Pat. No. 4,189,898, a receptacle is disposed adjacent a trailing end of an endless conveyor comprising a plurality of mutually spaced, parallel rotating rollers. Successive eggs are guided large end first into the receptacle. Upon a rotation of the receptacle, an egg located therein is turned around and assumes a position with the narrow end facing downwardly. As in U.S. Pat. No. 3,964,233, a pair of pivotably and shiftably mounted clam shell members receive the egg from the receptacle and move the egg into alignment with a receptacle of an egg carton or other container. Upon alignment, the shell members are pivoted into an opened or egg release configuration and the egg is deposited with the narrow end facing downwardly in the egg carton.

Various other orienting devices have been devised for use in conjunction with an egg loading apparatus. In general, all those other prior art systems provide a means for engaging an egg as it is being transferred from the conveyor into a packing carton or the like.

An object of the present invention is to provide an egg loading or packing apparatus with an improved means for orienting or aligning the eggs so that their narrow ends face downwardly in the receiving carton or container.

Another object of the present invention is to provide such an improved loading or packing apparatus wherein the egg transfer is accomplished reliably, easily and quickly without an unduly large number of component parts.

Another object of the present invention is to provide a method for loading or packing eggs into containers such as cartons wherein the method includes an improved method of orienting or aligning the eggs with their narrow ends facing downwardly.

SUMMARY OF THE INVENTION

An apparatus for loading eggs into cartons or other containers comprises, pursuant to the present invention, a pivotable holding or support plate at an egg alignment station for temporarily supporting an egg and further comprises a feeder or conveyor for delivering the egg to the plate member. A first guide member including a pair of opposing walls is disposed at the egg alignment station for limiting the positions assumable by the egg upon deposition thereof onto the plate member. The feeder or conveyor includes egg shifting means for eccentrically depositing the egg onto the plate member so that a narrow end of the egg contacts one of the walls and so that a large end of the egg is spaced from both of the walls upon a depositing of the egg onto the plate member. The first guide member further includes an additional wall opposing the plate member.

The apparatus for loading eggs into cartons or other containers further comprises a drive for pivoting the plate member about a substantially horizontal axis at a predetermined angular velocity upon a depositing of the egg onto the plate member. An automatic egg rotating element is provided at the egg alignment station for inducing the egg to rotate so that the narrow end is pointed downwardly upon a pivoting of the plate member from an egg holding position towards an egg release position. The automatic rotating element includes a shallow V-shaped portion on at least one of the plate member and the additional wall, the V-shaped portion extending inwardly towards the other of the plate member and the additional wall substantially midway between the opposing walls, whereby during an initial phase of a pivoting of the plate member a large end of the egg is temporarily held between the additional wall and the plate member while the narrow end swings downwardly.

The apparatus for loading eggs into cartons or other containers further comprises a catching device disposed below the guide chute for catching the egg, narrow end down, upon attainment of the egg release position by the plate member and for depositing the egg into an underlying egg carton. The catching device advantageously takes the form of a pair of pivotably and shiftably mounted clam shell members.

Pursuant to further features of the present invention, the feeder or conveyor includes a plurality of rotatable rollers extending parallel to one another and abutment means for limiting travel of the egg in a direction parallel to the rotatable rollers. Advantageously, the abutment means includes annular first stops and annular second stops on the rollers, the first stops being aligned with one another and with one of the opposing walls and the second stops being aligned with one another and with another of the opposing walls. The rollers are each rotatably connected to a pair of endless drive chains and are each provided at opposite ends with pinions meshingly engaging racks extending alongside the travel paths of the endless chains.

In accordance with the present invention, a method for transferring eggs from a conveyor to a transportable container, wherein the conveyor comprises an endless chain of rotatable rollers, comprises the step of rotating an egg along the rotatable rollers of the conveyor while advancing the egg thereon to cause a narrow end of the egg to take a position in engagement with an abutment disposed in a plane oriented substantially transversely with respect to the rotatable rollers and to cause the egg to roll off of the conveyor essentially in a horizontal orientation. In another step, a pivotably mounted plate member is disposed in a position to receive the egg as it falls off of the conveyor. The range of positions at which the egg is receivable on the plate member is delimited by a pair of opposing walls and an additional wall extending between the opposing walls opposite a mounting of the plate member, one of the plate member and the additional wall being provided with a shallow V-shaped portion extending inwardly towards the other of the plate member and the additional wall substantially midway between the opposing walls. Subsequent to the deposition of the egg on the plate member, the plate member is pivoted from a support position towards an egg release position. The egg is temporarily held, during an initial phase of a pivoting of the plate member, in a region about the large end of the egg between the V-shaped portion and the other of the plate member and the additional wall, allowing the narrow end of the egg to swing downwardly. The egg is dropped, narrow end first, upon the attainment of the egg release position by the plate member. In subsequent steps, the egg is caught and transferred, narrow end down, into a receptacle of a container.

BRIEF DESCRIPTION OF THE DRAWING

FIG. 2 is a partial top view of the conveyor and the series of guide chutes of FIG. 1.

FIG. 3 is a front elevational view of a guide member forming a portion of a guide chute of FIGS. 1 and 2.

DETAILED DESCRIPTION

Figure 1:
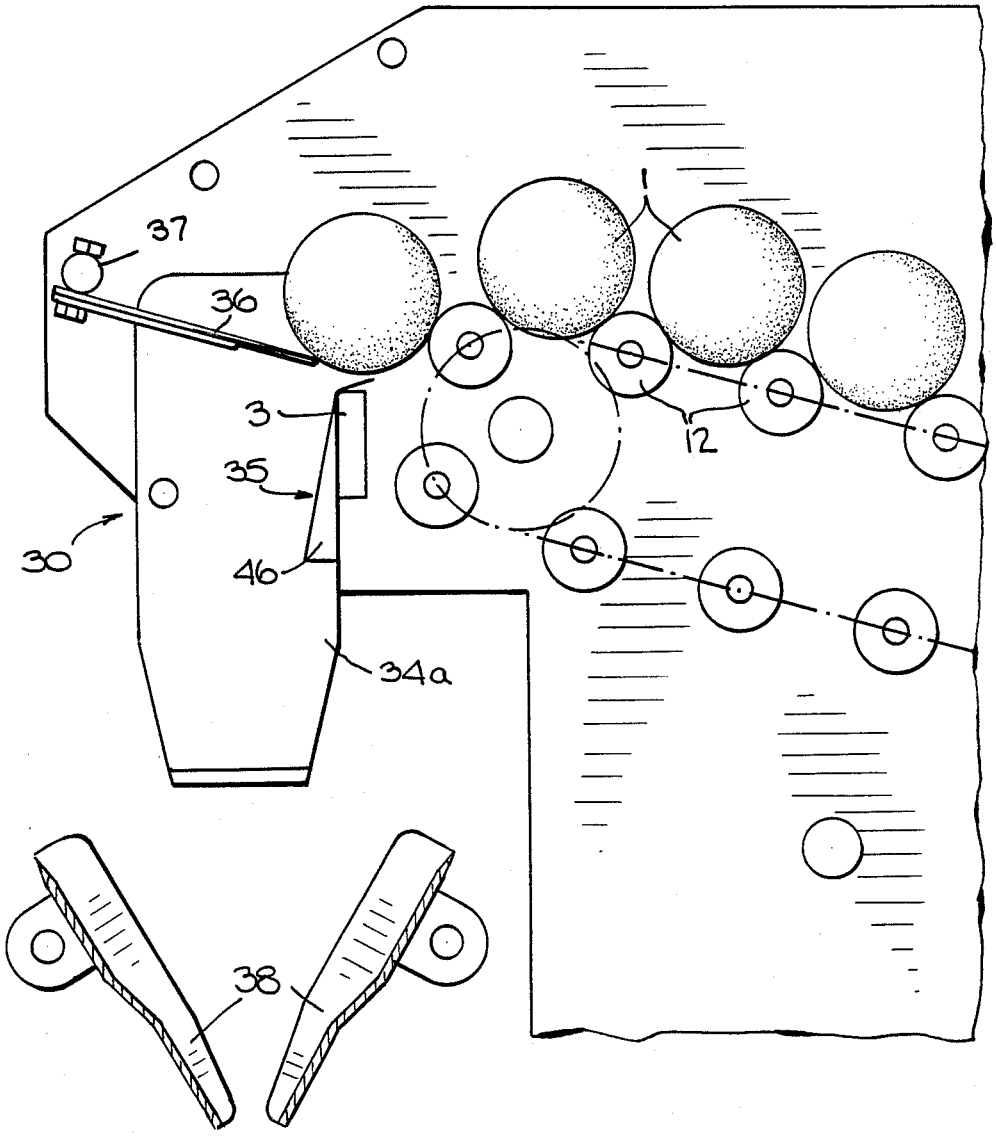
FIG. 1 is a partial, generally schematic vertical cross-sectional view of an egg packing or loading apparatus in accordance with the present invention, showing a conveyor for feeding eggs to a series of adjacent guide chutes.

As illustrated in FIGS. 1 and 2, an egg packing or loading apparatus in accordance with the present invention comprises an endless conveyor or feeder assembly 10 including a plurality of rotatable rollers 12 extending parallel to and spaced from each other. Rollers 12 are provided at opposite ends (only one end shown in FIG. 2) with respective pinions 22 which mesh with racks 24 located alongside rollers 12. Racks 24 and pinions 22 serve to automatically rotate rollers 12 as the rollers moved along an endless path, e.g., by a chain or other drive element. Such a rack and pinion rotary drive mechanism is disclosed in afore-mentioned U.S. Pat. No. 3,964,233.

Each roller 12 is provided, at spaced intervals therealong, with a plurality of stops in the form of annular flanges 26 preferably integral with the respective roller 12. As depicted in FIG. 2, stops 26 on any one roller 12 are aligned with corresponding stops 26 on other rollers to form a plurality of egg transport channels 28 or travel paths 28. Racks 24 extend parallel to transport channels 28.

Adjacent an output or trailing end of conveyor assembly 10 is provided a series of guide chutes 30 disposed in a linear configuration extending perpendicularly with respect to transport channels 28. Each guide chute 30 is aligned with a respective transport channel 28 to receive therefrom an egg 1 during each cycle of operation of the packing apparatus.

Each guide chute 30 has a pair of opposed side walls **34*a* and 34*b* which serve to limit the range of lateral positions available to an egg 1 inside the respective guide chute 30. At a side of each guide chute 30 opposite the conveyor assembly 10, the guide chute is defined by a plate member 36 fixed to a rotatable rod 37 so that the plate member is pivotable about a horizontal axis 40 between a substantially horizontal egg support position (see FIG. 1) and a substantially vertical egg release position (see FIG. 4). Opposite rod 37 guide chute 30 is defined by an additional wall member 35 (see FIGS. 2 and 3) extending between side walls 34*a* and 34*b*** perpendicularly thereto.

As depicted in FIG. 3, side walls **34*a*, 34*b* and 35 may form a modular unit wherein wall 35 is a bight connecting side walls 34*a* and 34*b* to one another. Wall or bight 35 has a width $w_c$ much less than heights $w_a$ and $w_b$ ($w_a = w_b$) of side walls 34*a* and 34*b*. Side walls 34*a* and 34*b* are provided at their lower ends with inwardly extending portions 42*a* and 42*b* in turn provided at their lower tips with outwardly turned hooks 44*a* and 44*b*. Inwardly extending portions 42*a* and 42*b* serve to direct eggs from the respective guide chute 30 into a respective underlying pair of pivotably and shiftably disposed clam shell members 38. Hooks 44*a* and 44*b* function to blunt the lower ends of side walls 34*a* and 34*b*** for purposes of operator protection.

Each wall 35 is provided with a shallow V-shaped portion 46 extending inwardly towards the respective plate member 36 substantially midway between side walls **34*a* and 34*b*. As shown in FIG. 3, V-shaped portion 46 has a width $w_v$ which increases from an upper end of wall 35 towards a lower end thereof. As described in detail hereinafter, V-shaped portion 46 serves to automatically rotate an egg 1 so that the narrow end of the egg is pointed downwardly upon a pivoting of plate member 36 from its egg support position towards its egg release position. During an initial phase of a pivoting of the plate member, a large end of the egg is temporarily held between wall 35 and plate member 36 while the narrow end of the egg swings downwardly. In accordance with the present invention, the egg orientation or alignment function can be implemented by providing a shallow V-shaped portion 49 also on plate member 36, as illustrated at the right side of FIG. 2. Alternatively, the plate member alone may be formed with the V-shaped portion. In any case, guide chute 30 is formed to have a width $w_g$ which is less in a central region of the guide chute than at side walls 34*a* and 34*b***.

Figure 4:
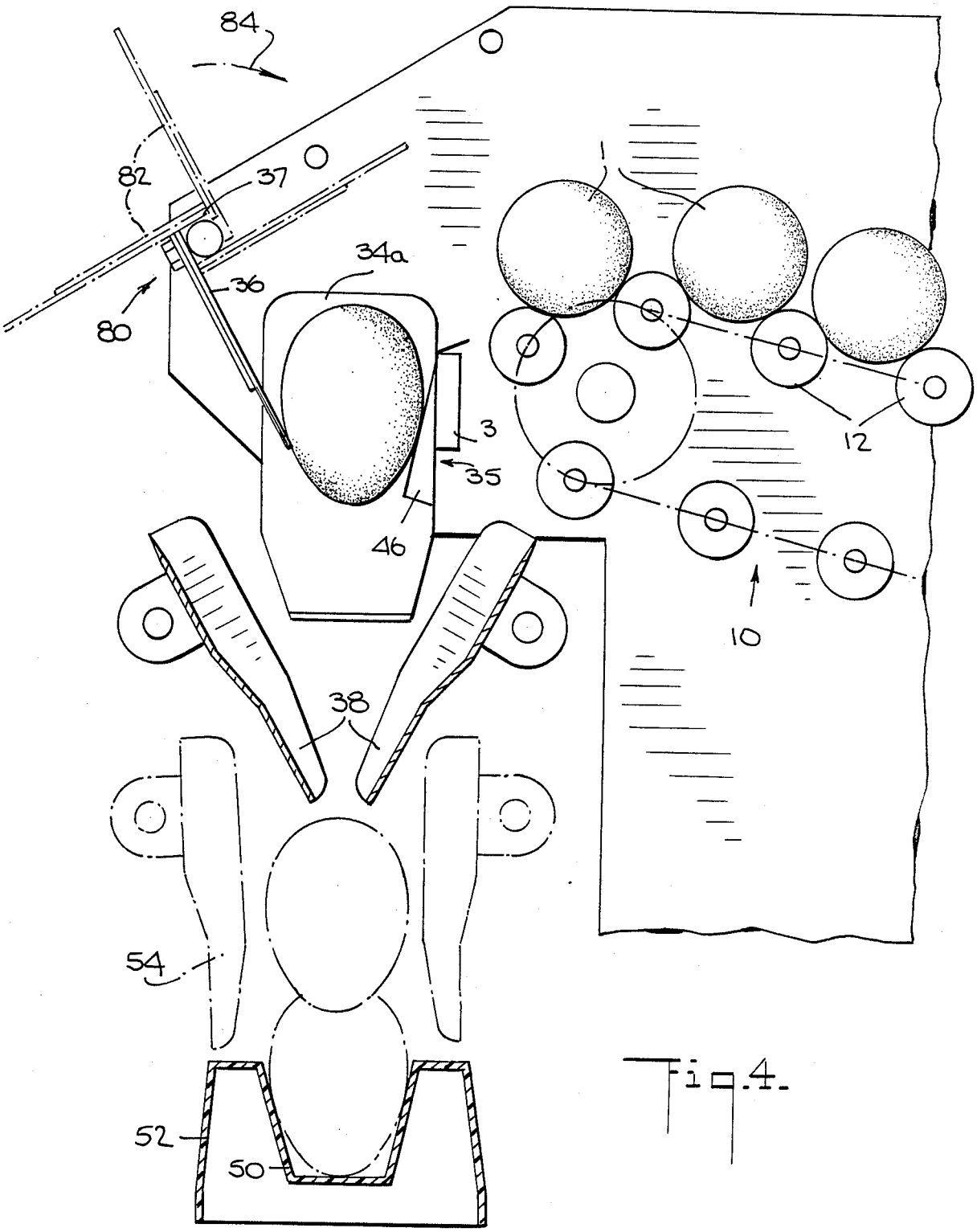
FIG. 4 is a partial, generally schematic vertical cross-sectional view, similar to FIG. 1, showing the egg packing apparatus of that drawing figure during an egg orienting or aligning operation.

As shown in FIGS. 1 and 4, the egg packing apparatus further comprises an egg catching and depositing device in the form of pivotably and shiftably disposed clam shell members 38. Clam shell members are of the same type and operate in the same manner as those described in U.S. Pat. No. 3,964,233. To summarize, each of a plurality of clam shell assemblies including clam shell members 38 are draw-link connected to one another and adapted to receive eggs from a respective guide chute 30. Beneath the series of guide chutes 30, the clam shell assemblies are spaced from each other. Because the center to center spacing of receptacles 50 (FIG. 4) in an underlying egg carton 52 is different and smaller than the center to center spacing of the clam shell assemblies, the clam shell assemblies are moved laterally (parallel to the series of guide chutes 30). As the shell assemblies descend towards egg carton 52, the shell assemblies are moved towards each other to accommodate the difference in lateral spacing. The means for accomplishing this operation is fully described in U.S. Pat. No. 3,964,233 which is incorporated by reference herein.

In the operation of the egg packing apparatus, eggs 1 are moved from a reservoir (not illustrated) onto conveyor assembly 10. Rotating rollers 12 cause the eggs to shift laterally, in the axial direction of rollers 12, so that the eggs are positioned with their narrow ends in contact with a pair of aligned stops 26, as shown in FIG. 2. As an egg 1 leaves conveyor assembly 10, it falls from the associated transport channel 28 onto the plate member 36 of the respective guide chute 30 (see FIG. 1). The narrow end of the egg is then in engagement with one of side walls 34*a* and 34*b*, while the larger end of the egg is spaced from both of the side walls. At that juncture, rod 37 is turned and plate member 36 pivoted about axis 40 at a predetermined, essentially uniform angular velocity, whereupon the large end of the egg is held between plate member 36 and V-shaped portion 46 of wall 35 while the narrow end of the egg swings downwardly. As plate member 36 continues to pivot, the egg slides downwardly and laterally owing to the increasing width of V-shaped portion 46 (FIG. 3). The lateral motion of the egg is arrested by the respective side wall 34*a* and 34*b* towards which the egg has shifted. The egg then slides downwardly along the respective side wall. As plate member 36 reaches a predetermined, substantially vertical position, the egg is released and falls towards underlying clam shell members 38. As the egg falls past the lower end of the side wall, the egg is guided laterally inwardly by the inwardly extending lower portion 42*a* or 42*b* of the respective side wall 42*a* or 42*b*. The egg then slides to the bottom of the closed clam shells 38 which subsequently move downwardly and laterally into the dot-dash position 54 illustrated in FIG. 4. Upon an opening of clam shell members 38, the egg is placed narrow end down in receptacle 50 of carton 52. The method of the present invention has proven to be a simplified and reliable method of orienting and aligning eggs during an egg packing operation.

Figure 5:
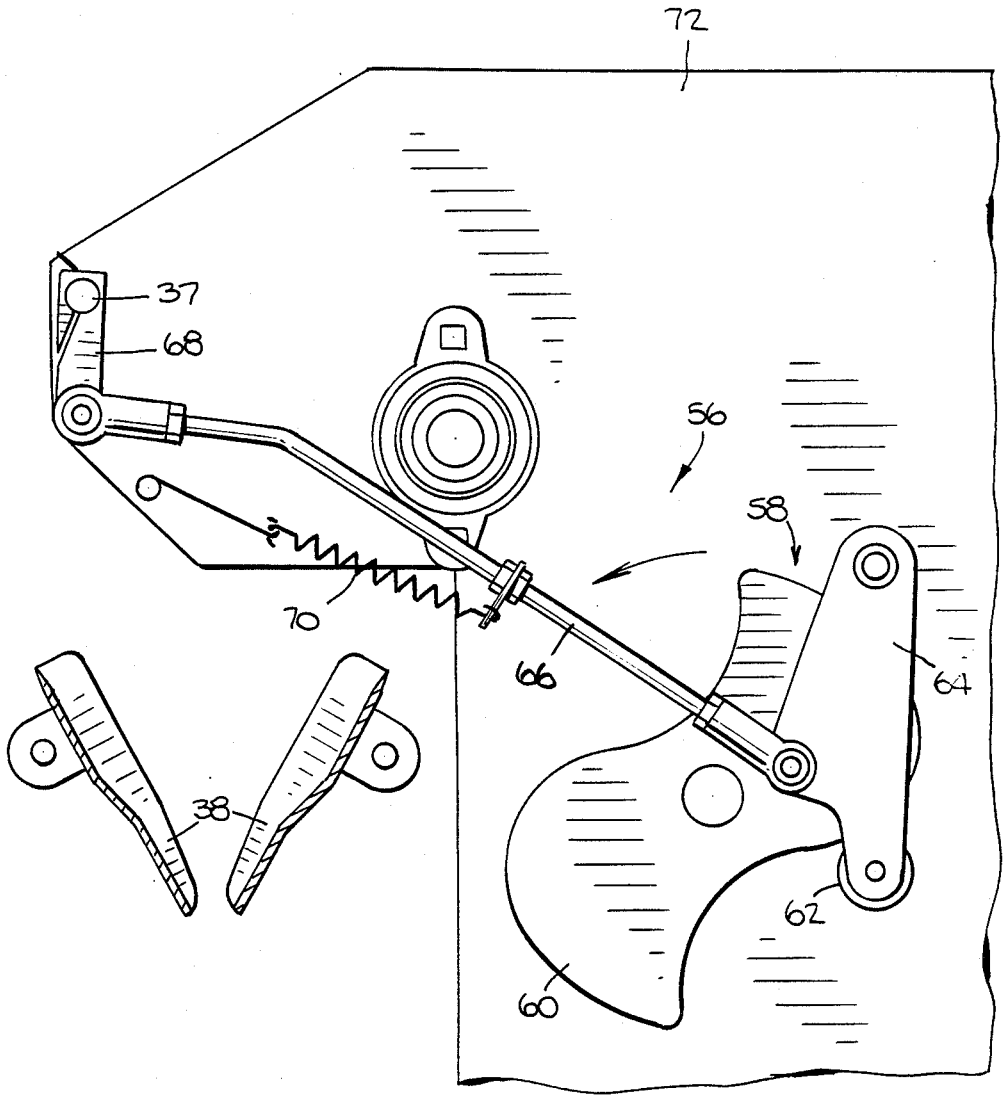
FIG. 5 is a partial, schematic cross-sectional view of the egg packing apparatus of FIGS. 1 and 4, showing a cam mechanism for controlling and synchronizing operation of various movable components.

FIG. 5 illustrates in schematic detail a control assembly 56 which includes a cam mechanism 58 for controlling and synchronizing the pivoting of rod 37 and plate members 36, the motion of conveyor assembly 10 and the pivoting and shifting of clam shell members 38. Cam mechanism 58 includes a double lobe cam 60 and a cam follower 62 mounted to a pivotably disposed lever arm 64 in turn pivotably connected to a rod 66. Rod 66 is coupled at an end opposite lever 64 to a bracket 68 in turn fixed to rod 37 and is biased by a spring 70. Cam 60, lever 64 and rod 37 are all pivotably or rotatably mounted to a frame plate 72. During a single rotation of cam 60, plate members 36 experience two pivoting cycles and two eggs are deposited into carton 52. In a manner well known in the art, control assembly 56 moves conveyor assembly 10 so that spools or rollers 12 rotate once during each operating cycle of the packing apparatus.

As illustrated in FIG. 4, plate member 36 may form one member of a rotating wheel 80 having a plurality of generally radially extending plate members 82. Wheel 80 rotates at a substantially uniform angular velocity in the direction indicated by arrow 84. The rotation of wheel 80 is easily coordinated with the opening, closing and shifting of clam shell members 38. Implementation of such synchronization would pose no problem to one of ordinary skill in the art.

Although the invention has been described in terms of particular embodiments and applications, one of ordinary skill in the art, in light of this teaching, can generate additional embodiments and modifications without departing from the spirit of or exceeding the scope of the claimed invention. Accordingly, the drawings and decriptions herein are proferred by way of example to facilitate comprehension of the invention and should not be construed to limit the scope thereof.

What is claimed is:

1. An apparatus for loading eggs into transportable containers, comprising:

holding means including a pivotable plate member at an egg alignment station for temporarily supporting an egg;

feeding means for conveying said egg to said plate member;

first guide means at said egg alignment station for limiting the positions assumable by said egg upon deposition thereof onto said plate member, said guide means including a pair of opposing walls, said feeding means including egg shifting means for eccentrically depositing said egg onto said plate member so that a narrow end of said egg contacts one of said walls and so that a large end of said egg is spaced from both of said walls upon a depositing of said egg onto said plate member, said first guide means further including an additional wall opposing said plate member;

means for pivoting said plate member about a substantially horizontal axis at a predetermined angular velocity upon a depositing of said egg onto said plate member;

automatic rotating means at said egg alignment station for inducing said egg to rotate so that said narrow end is pointed downwardly upon a pivoting of said plate member from an egg holding position towards an egg release position, said automatic rotating means including a shallow V-shaped portion on at least one of said plate member and said additional wall, said V-shaped portion extending inwardly towards the other of said plate member and said additional wall substantially midway between said opposing walls, whereby during an initial phase of a pivoting of said plate member a large end of said egg is temporarily held between said additional wall and said plate member while said narrow end swings downwardly; and catching means disposed below said guide chute for catching said egg, narrow end down, upon attainment of said egg release position by said plate member and for depositing said egg into an underlying container.

2. The apparatus defined in claim 1 wherein said additional wall takes the form of a bight connecting said opposing walls to one another.

3. The apparatus defined in claim 2 wherein said additional wall has said V-shaped portion.

4. The apparatus defined in claim 3 wherein said V-shaped portion increases in width from an upper end of said additional wall towards a lower end thereof.

5. The apparatus defined in claim 1 wherein said plate member has said V-shaped portion.

6. The apparatus defined in claim 5 wherein said means for pivoting includes a rotatable rod extending along said axis, said plate member being attached to said rod.

7. The apparatus defined in claim 6 wherein said additional wall has a V-shaped portion extending towards said plate member.

8. The apparatus defined in claim 1 wherein said feeding means includes an endless conveyor with a plurality of rotatable rollers extending parallel to one another.

9. The apparatus defined in claim 8 wherein said feeding means includes abutment means for limiting travel of said egg in a direction parallel to said rotatable rollers.

10. The apparatus defined in claim 9 wherein said abutment means includes annular first stops on said rollers, said first stops being aligned with one another and with one of said opposing walls, said abutment means further including substantially annular second stops on said rollers, said second stops being aligned with one another and with another of said opposing walls.

11. The apparatus defined in claim 10 wherein said rollers are each rotatably connected to a pair of endless drive chains, further comprising drive means for moving said chains along predetermined travel paths.

12. The apparatus defined in claim 11 wherein said rollers are provided at opposite ends with pinions, said pinions meshingly engaging racks extending alongside said travel paths.

13. The apparatus defined in claim 11 wherein said plate member is formed as a portion of a rotatable wheel having other plate members all angularly spaced from one another.

14. The apparatus defined in claim 13 wherein said wheel is rotated at a uniform angular velocity.

15. An apparatus for loading eggs into transportable containers, comprising:

receiving means including a guide chute for receiving an egg, said guide chute having a pair of substantially vertical side walls generally parallel to and spaced from one another, said guide chute also having an additional wall on a side extending between said side walls;

holding means for temporarily supporting said egg in said guide chute, said holding means including a pivotably mounted plate member disposed substantially opposite said additional wall, at least one of said additional wall and said plate member having a shallow V-shaped portion extending inwardly into an interior of said guide chute substantially midway between said side walls, whereby said guide chute has a minimum width in a central region of said guide chute upon a pivoting of said plate member from a support position;

feeding means for conveying said egg to said guide chute and eccentrically depositing said egg onto said plate member, a narrow end of said egg contacting one of said side walls upon a depositing of said egg onto said plate member;

means for pivoting said plate member about a substantially horizontal axis at a predetermined angular velocity upon a depositing of said egg onto said plate member, whereby during an initial phase of a pivoting of said plate member a large end of said egg is temporarily held between said additional wall and said plate member at the central region of said guide chute while said narrow end swings downwardly; and catching means disposed below said guide chute for catching said egg, narrow end down, upon a sufficient pivoting of said plate member and depositing said egg into an underlying container.

16. The apparatus defined in claim 15 wherein said additional wall takes the form of a bight connecting said side walls to one another.

17. The apparatus defined in claim 16 wherein said additional wall has said V-shaped portion.

18. The apparatus defined in claim 17 wherein said V-shaped portion increases in width from an upper end of said additional wall towards a lower end thereof.

19. The apparatus defined in claim 15 wherein said plate member has said V-shaped portion.

20. The apparatus defined in claim 19 wherein said plate member is attached to a rotatable rod extending along said axis.

21. The apparatus defined in claim 19 wherein said additional wall also has a V-shaped portion extending inwardly into said interior of said guide chute substantially midway between said side walls.

22. The apparatus defined in claim 15 wherein said feeding means includes an endless conveyor with a plurality of rotatable rollers extending parallel to one another.

23. The apparatus defined in claim 22 wherein said feeding means includes abutment means for limiting travel of said egg in a direction parallel to said rotatable rollers.

24. The apparatus defined in claim 23 wherein said abutment means includes annular first stops on said rollers, said first stops being aligned with one another and with one of said opposing walls, said abutment means further including substantially annular second stops on said rollers, said second stops being aligned with one another and with another of said opposing walls.

25. The apparatus defined in claim 24 wherein said rollers are each rotatably connected to a pair of endless drive chains, further comprising drive means for moving said chains along predetermined travel paths.

26. The apparatus defined in claim 25 wherein said rollers are provided at opposite ends with pinions, said pinions meshingly engaging racks extending alongside said travel paths.

27. The apparatus defined in claim 15 wherein said plate member is formed as a portion of a rotatable wheel having other plate members all angularly spaced from one another.

28. The apparatus defined in claim 27 wherein said wheel is rotated at a uniform angular velocity.

29. A method for transferring eggs from a conveyor to a transportable container, said conveyor comprising an endless chain of rotatable rollers, said method comprising the steps of:

rotating an egg along the rotatable rollers of said conveyor while advancing the egg thereon to cause a narrow end of the egg to take a position in engagement with an abutment disposed in a plane oriented substantially transversely with respect to said rotatable rollers and to cause the egg to roll off of said conveyor essentially in a horizontal orientation;

disposing a pivotably mounted plate member in a position to receive the egg as it falls off of said conveyor;

receiving the falling egg on said plate member;

delimiting, by a pair of opposing walls and an additional wall extending between said opposing walls opposite a mounting of said plate member, a range of positions at which the egg is receivable on said plate member, one of said plate member and said additional wall being provided with a shallow V-shaped portion extending inwardly towards the other of said plate member and said additional wall substantially midway between said opposing walls;

rotating said plate member from a support position towards an egg release position;

temporarily holding the egg, during an initial phase of a pivoting of said plate member, in a region about the large end of the egg between said V-shaped portion and said other of said plate member and said additional wall, allowing the narrow end of the egg to swing downwardly;

dropping the egg, narrow end first, upon the attainment of said egg release position by said plate member;

catching the egg upon dropping thereof; and transferring the egg, narrow end down, into a receptacle of a container.

30. The method defined in claim 29 wherein said step of catching comprises the step of placing the egg with its narrow end down between a pair of pivotable and shiftable clam shell members, said step of transferring including the steps of shifting said clam shell members and pivoting said clam shell members to open same to release the egg.

* * * * *